US005476082A

United States Patent [19]

Carpenter et al.

[11] Patent Number: 5,476,082

[45] Date of Patent: Dec. 19, 1995

[54] FLYWHEEL MAGNET FUEL INJECTION ACTUATOR

[75] Inventors: Todd L. Carpenter, Gregory; Dennis P. Ward, Ann Arbor, both of Mich.

[73] Assignee: Tecumseh Products Company, Tecumseh, Mich.

[21] Appl. No.: 263,768

[22] Filed: Jun. 22, 1994

[51] Int. Cl.[6] ..... F02M 51/00

[52] U.S. Cl. ..... 123/478; 123/472

[58] Field of Search ..... 123/149 D, 470, 123/472, 475, 476, 478, 490

[56] References Cited

U.S. PATENT DOCUMENTS

| | | | |
|---|---|---|---|
| 2,829,631 | 4/1958 | Wilt | 123/475 |
| 2,918,911 | 12/1959 | Guiot | 123/478 |
| 4,160,435 | 7/1979 | Sleder | 123/599 |
| 4,261,437 | 4/1981 | Zavatkay | 185/45 |
| 4,727,851 | 3/1988 | Orova | 123/601 |
| 4,873,962 | 10/1989 | Safranek | 123/599 |
| 4,890,593 | 1/1990 | Goulet | 123/676 |
| 4,892,079 | 1/1990 | Umezu | 123/602 |
| 4,924,831 | 5/1990 | Piteo | 123/417 |
| 4,951,625 | 8/1990 | Okuda | 123/198 DC |
| 5,161,496 | 11/1992 | Matsushima | 123/185.3 |
| 5,172,675 | 12/1992 | Kurosu | 123/599 |
| 5,216,994 | 6/1993 | Aoki | 123/490 |
| 5,398,654 | 3/1995 | Niebrzydoski | 123/445 |

*Primary Examiner*—Tony M. Argenbright
*Attorney, Agent, or Firm*—Baker & Daniels

[57] ABSTRACT

The present invention involves a fuel injection system for an internal combustion engine for small utility implements. The engine includes a crankcase with a cylinder bore. The crankcase rotatably supports a crankshaft having a flywheel and a magnet disposed on an outer periphery of the flywheel. The crankshaft is also connected to a reciprocating piston disposed in the cylinder bore. A cylinder head is attached to the crankcase over the cylinder bore, and a fuel injector is disposed in the cylinder head. The fuel injector is in communication with a fuel supply and can inject quantities of fuel into the cylinder head. An induction coil is disposed adjacent to the flywheel, and is coupled to the fuel injector so that rotation of the flywheel generates a pulse on the induction coil that actuates the fuel injector. A fuel pump is driven by the crankshaft and supplies pressurized fuel to the injector. A timing control circuit is connected to the fuel injector and the induction coil to regulate the operation of the fuel injector. The timing control circuit interrupts the induction coil with a pulse width modulated signal when the duration of the actuating pulse exceeds a calculated duration to close the fuel injector. A pressure sensor is disposed in the cylinder head and provides an input to the timing control circuit.

20 Claims, 3 Drawing Sheets

FLYWHEEL MAGNET FUEL INJECTION ACTUATOR

BACKGROUND OF THE INVENTION

1. Field of the Invention

The present invention relates to fuel injection systems for small utility engines. More particularly, the field of the invention involves actuators for fuel injectors in such small utility engines.

2. Description of the Related Art

Electronic fuel injection systems are known which utilize pulse width modulation to regulate fuel flow through an injector between a fuel pump and the manifold on the cylinder head. These type of systems are common in automotive applications, wherein an electronic timing control circuit delivers the pulse width modulated signal to the solenoid of the fuel injector. The timing control circuit is powered by the power system of the engine, initially by the engine battery until the alternator can provide a constant DC power source. However, such systems are not compatible with engines of small utility engines, such as for lawn mowers, garden tillers, and the like, as those small utility engines do not have a battery for the initial operation of the electronic timing control circuit.

One known fuel injection system overcomes this difficulty in applying fuel injection technology to small utility engines which do not have a battery. This known system comprises an ignition unit disposed radially outward adjacent to a magnet mounted to the external periphery of the flywheel. The ignition unit includes a built-in ignition coil for providing an induced current through a wire attached to the spark plug. The fuel injection system includes the flywheel which has a plurality of magnets mounted at its radially inward periphery. The flywheel rotates about a stator core having a plurality of windings around each pole projection. The magnets are electrically associated with stator projections for inducing a current in the winding. The output from the windings functions as an input to a power supply circuit for an electronic timing control circuit. The timing control circuit receives input signals from a crank angle sensor, an engine coolant temperature sensor, a throttle valve opening sensor, and an intake air temperature sensor. The timing control circuit controls both the start timing and the duration of operation for the fuel injection valve. The flywheel and stator define an AC generator providing power to the timing control circuit. The AC generator must be sized large enough to power the timing control circuit at a very low engine speed to facilitate starting of the engine. Additionally, the AC generator must supply enough power to energize the fuel injector at any time.

A difficulty with this known design involves the expense of providing the magnets, windings, and associated material which form the power supply circuit. Also, a separate sensor is required to provide the timing control circuit with information regarding the operating condition of the engine. This arrangement requires a significant increase in the amount of materials required to support and operate the timing control circuit. The increased amount of materials, and the additional sensors required, adds to the expense of the engine. Additionally, the weight of the engine is increased, which impairs the operation and/or efficiency of the small utility equipment.

SUMMARY OF THE INVENTION

The present invention is a fuel injection system for a small utility engine which actuates the fuel injector from the rotation of the flywheel. The flywheel has a magnet which creates a pulse in an induction coil that is operably connected to the fuel injector and provides all of the power needed to actuate the fuel injector solenoid. With the present invention, the timing control is inherent in the positioning of the flywheel magnet, so that the fuel injector is properly synchronized with the rotation of the crankshaft. Also, the injector is actuated upon the turning of the flywheel without having to wait for actuation by an electronic timing control circuit. Once the engine is started, the rotation of the flywheel creates a steady power source for an electronic control circuit which can optimize the operation of the fuel injector. The control circuit can operate the fuel injector according to feedback from the engine and from the pressure and/or temperature conditions of the cylinder manifold.

The actuation of the fuel injector by the induction coil creates a fuel rich condition in the engine cylinder, which is desired during the starting of the engine. However, the duration of the actuation by the induction coil may be controlled by the timing control circuit. The induction coil may be interrupted by the timing control circuit, so that the pulse of the induction coil may be cut short by the timing control circuit. Thus, the timing control circuit can both sense the operational state of the engine and optimize the control of the fuel injector.

The timing control circuit also has a manifold sensor which monitors the absolute pressure within the cylinder head intake manifold. The intake manifold pressure is related to the throttle position and the engine speed. Therefore, the timing control unit can determine the load inside the cylinder. This allows the timing control circuit to regulate the fuel injector according to the two most closely related conditions of the engine, the rotational speed of the crankshaft and the load.

The present invention advantageously includes a fuel pump driven by the camshaft. The camshaft is driven by the crankshaft at half the speed of the crankshaft. Therefore, the fuel pump will only deliver fuel pressure on every other crankshaft revolution and the timing of the fuel pressure is to be synchronized with the injector pulse. This eliminates the need for a "phase sensing" switch because the fuel pressure pulse will only deliver fuel every other crankshaft revolution as required by a 4-stroke cycle engine. The fuel pump thereby provides pressurized fuel to the fuel injector.

The invention also has a timing control circuit which is operably connected to regulate the operation of the fuel injector. The timing control circuit regulates the operation of the fuel injector based on an observed frequency of pulses from the induction coil. The timing control circuit interrupts the current path to the fuel injector when the duration of the pulse from the induction coil exceeds a calculated duration to close the fuel injector. A voltage regulator provides power to the timing control circuit, and is also coupled to the induction coil.

The invention utilizes a transistor switch that controls fuel injector current. The timing control circuit is operatively associated with the switch and is capable of closing the switch to deenergize the fuel injector. The timing control circuit provides a modulated pulse width signal to the switch to regulate its state and thereby regulate the actuation of the fuel injector.

The present invention, in one form, involves an internal combustion engine comprising a crankcase, crankshaft, camshaft, fuel pump, fuel injector, and an induction coil. The crankcase includes a cylinder bore. The crankshaft is rotatably disposed in the crankcase, and includes a flywheel and a magnet disposed on an outer periphery of the flywheel. The crankshaft is also operably connected to a piston disposed in the cylinder bore. The fuel injector is in communication with a fuel supply to inject quantities of fuel into the intake manifold at an injection location. The induction coil is disposed adjacent to the flywheel and to the magnet during its rotation, with the coil being coupled to the fuel injector whereby rotation of the flywheel generates a pulse on the induction coil and actuates the fuel injector.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
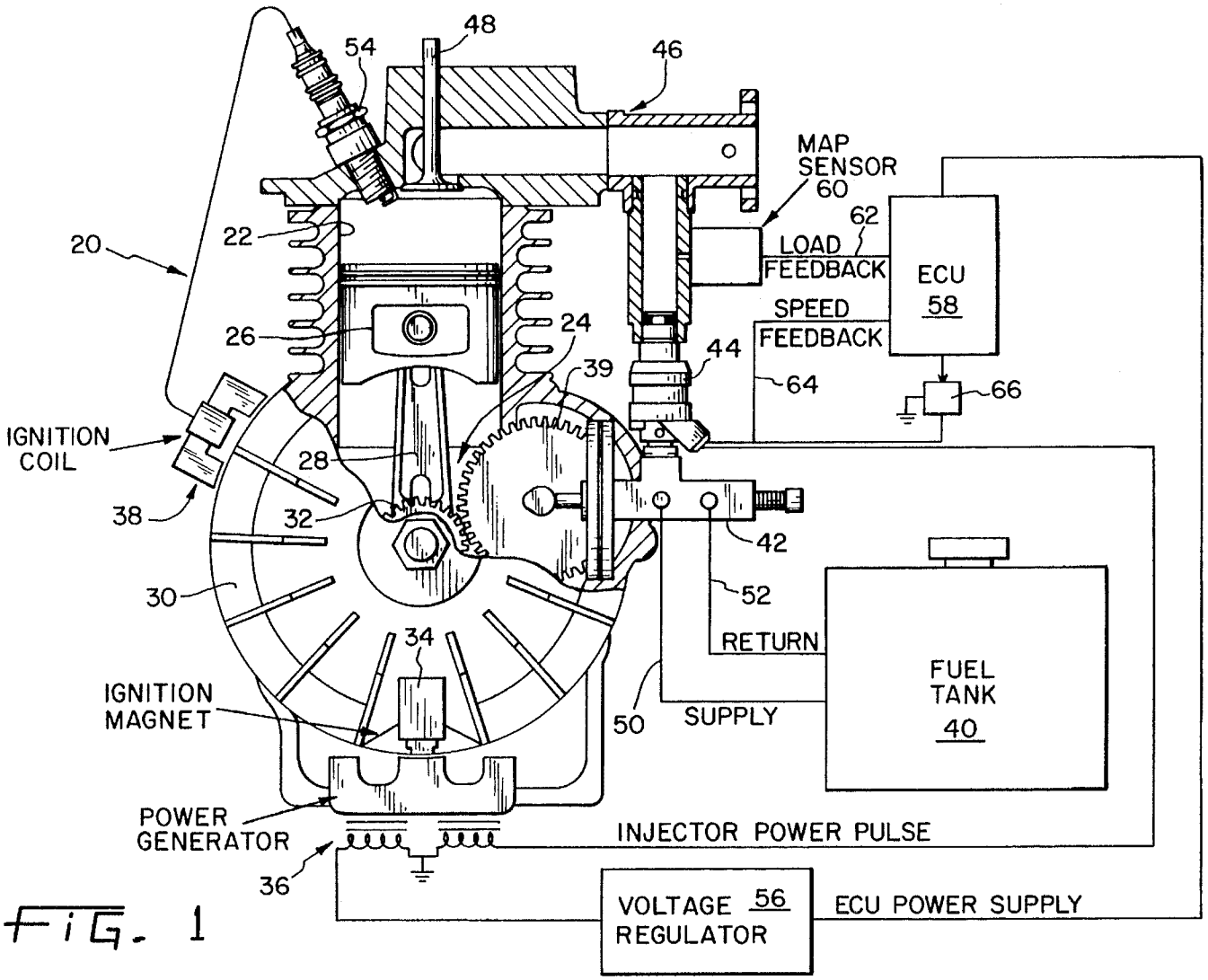
FIG. 1 is a schematic view of the present invention.

Corresponding reference characters indicate corresponding parts throughout the several views. Although the drawings represent an embodiment of the present invention, the drawings are not necessarily to scale and certain features may be exaggerated in order to better illustrate and explain the present invention. The exemplification set out herein illustrates one preferred embodiment of the invention, in one form, and such exemplification is not to be construed as limiting the scope of the invention in any manner.

DESCRIPTION OF THE PREFERRED EMBODIMENT

The preferred embodiment disclosed below is not intended to be exhaustive or limit the invention to the precise form disclosed in the following detailed description. Rather, the embodiment is chosen and described so that others skilled in the art may utilize its teachings.

The present invention relates to a small engine such as the four stroke cycle engine shown in FIG. 1. Crankcase 20 includes cylinder 22, and rotatably supports crankshaft 24. Crankshaft 24 is connected to piston 26 in a conventional manner, such as by connecting rod 28, so that piston 26 reciprocates within cylinder 22 when crankshaft 24 rotates. Crankshaft is also rotatably connected with flywheel 30 and crankshaft gear 32. Flywheel 30 carries ignition magnet 34 which is attached at the outer periphery of its disc-shaped body. Induction coil 36 and ignition coil 38 are disposed just outside of the outer perimeter of flywheel 30. Coils 36 and 38 act as magnetic receivers in the form of metallic laminations forming poles, e.g., E or I shaped laminations, arranged so that magnetic fields are induced within windings disposed on the poles. As described in further detail below, the rotation of magnet 34 induces electric signal pulses which drive the engine.

Fuel is introduced into cylinder 22 through a fuel supply system comprising fuel tank 40, fuel pump 42, fuel injector 44, manifold 46, and valve 48. Fuel tank 40 is of conventional design, and holds fuel, e.g. gasoline, propane, or other suitable material, for combustion in cylinder 22. Fuel is conveyed to fuel pump 42 via supply line 50, and excess fuel is returned to fuel tank 40 by return line 52. Fuel pump 42 pressurizes the fuel when crankshaft gear 32 rotates camshaft 39 to create the mechanical pumping action. Camshaft 39 drives fuel pump 42 in an arrangement which ensures that once every two rotations of crankshaft 24, sufficient pressure is created to thereby ensure delivery of fuel at the optimum point in the four stroke cycle. Fuel injector 44 is periodically opened, as will be described in greater detail below, to allow the flow of fuel into manifold 46. Manifold or cylinder head 46 may include venting or other structural features which allow the injected fuel to mix with air in manifold 46. Valve 48, typically cam actuated, selectively opens to allow the introduction of the air-fuel mixture into cylinder 22.

Spark plug 54 is positioned in crankcase 20 so that its spark gap is in communication with the interior of cylinder 22, and is electrically connected to ignition coil 38. The pulses generated by ignition coil 38 are sufficiently strong to create a spark by spark plug 54. Induction coil 36 is electrically connected to fuel injector 44, and the pulses generated by induction coil 36 are sufficiently strong to actuate the solenoid in fuel injector 44. In addition, induction coil 36 is electrically connected to voltage regulator 56 which provides a relatively constant voltage source for electronic control unit (ECU) 58. ECU 58 receives a signal indicative of the load in manifold 46 from manifold absolute pressure (MAP) sensor 60 through load feedback line 62. ECU 58 also receives a signal indicative of the engine speed from fuel injector 44 through speed feedback line 64. Fuel injector 44 is also connected to cutout switch 66 which ECU 58 operates to regulate the amount of time that fuel injector 44 is open.

The operation of the arrangement of FIG. 1 begins by manually rotating crankshaft 24 by pulling a recoil starter rope and thereby causing rotation of a flywheel pulley (not shown). The rotation of crankshaft 24 causes flywheel 30 and crankshaft gear 32 to rotate. Flywheel 30 carries ignition magnet 34 which induces pulses in induction coil 36 and ignition coil 38. Crankshaft gear 32 drives camshaft 39 which actuates fuel pump 42 to supply pressurized fuel to fuel injector 44. The arrangement of coils 36 and 38 are such that fuel injector 44 is opened first so that fuel enters manifold 46 and mixes with air. Cam driven valve 48 then opens at the appropriate point in the combustion cycle to allow the air-fuel mixture to pass from manifold 46 to cylinder 22. Near the end of the upstroke of piston 26, when piston 26 is closest to the top of cylinder 22, a spark is generated by spark plug 54 to ignite the air-fuel mixture and thereby drive crankshaft 24. Once the speed of crankshaft 24 is sufficiently high, the pulses generated by induction coil 36 are sufficient to allow voltage regulator 56 to activate ECU 58. Finally, ECU 58 monitors the condition of the engine through load feedback line 62 and speed feedback line 64 to optimize the operation of fuel injector 44. A more detailed explanation of the operation of the circuitry generally shown in FIG. 1 is provided in FIG. 2.

Figure 2:
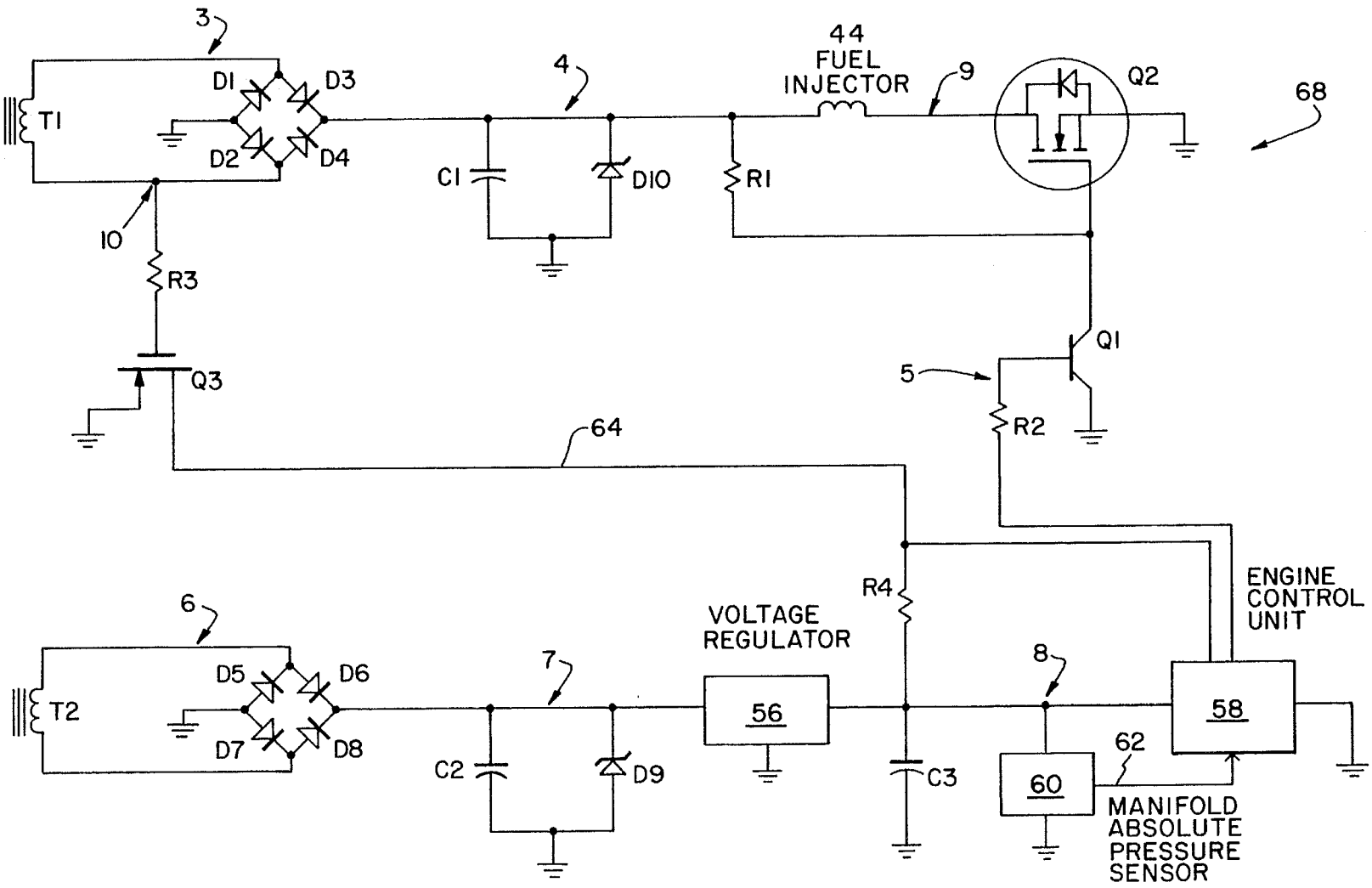
FIG. 2 is a circuit diagram of the fuel injection system of FIG. 1.
Figure 3:
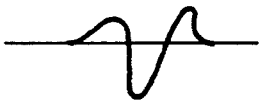
FIG. 3 is a graph of the electrical signal at node 3 during operation of the circuit of FIG. 2.
Figure 4:
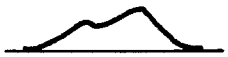
FIG. 4 is a graph of the electrical signal at node 4 during operation of the circuit of FIG. 2.

FIG. 2 shows an electrical schematic diagram of fuel injection circuit 68. Induction coil 36 of FIG. 1 is comprised of windings T1 and T2. Winding T1 provides the actuating pulse to fuel injector 44, and is connected to a standard bridge rectifier formed by diodes D1–D4. The signal apparent at node 3 during the rotation of flywheel 30 is shown in FIG. 3. The rectified signal then traverses a filtering arrangement formed by capacitor C1 and Zener diode D10 being connected in parallel to ground. The rectified, filtered signal apparent at node 4 is shown in FIG. 4, and provides a power pulse with sufficient voltage, current, and duration to actuate fuel injector 44, which is depicted in FIG. 2 as a solenoid coil.

Fuel injector 44 is arranged so that the power pulse generated in winding T1 causes sufficient current at node 4 to actuate the solenoid and thereby open the fuel injector. Node 4 is connected in series through fuel injector 44 and transistor Q2 to ground. Resistor R1 and transistor Q1 are parallel to the fuel injector circuit, with the connection of resistor R1 and transistor Q1 including the gate of FET transistor Q2. As voltage builds on node 4, the gate of FET Q2 turns on that transistor, allowing current to flow through fuel injector 44. However, when transistor Q1 is turned on by ECU 58, the current through fuel injector 44 is interrupted or stopped by FET Q2, thus fuel injector 44 is deenergized. In this manner, ECU method actuation of fuel injector 44.

Figure 6:
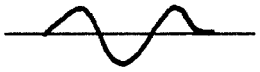
FIG. 6 is a graph of the electrical signal at node 6 during operation of the circuit of FIG. 2.
Figure 7:
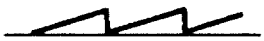
FIG. 7 is a graph of the electrical signal at node 7 during operation of the circuit of FIG. 2.
Figure 8:
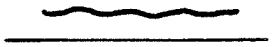
FIG. 8 is a graph of the electrical signal at node 8 during operation of the circuit of FIG. 2.

Winding T2 provides power for operating ECU 58, and is connected to a standard bridge rectifier formed by diodes D5–D8. The signal apparent at node 6 during the rotation of flywheel 30 is shown in FIG. 6. The rectified signal then traverses a filtering arrangement formed by capacitor C2 and Zener diode D9 being connected in parallel to ground. The rectified, filtered signal apparent at node 7 is shown in FIG. 7, and provides power to voltage regulator 56. The output of voltage regulator 56 is further smoothed by capacitor C3 to provide a relatively constant voltage signal at node 8 and shown in FIG. 8. The voltage at node 8 provides power to MAP sensor 60 and ECU 58.

Figure 5:
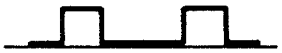
FIG. 5 is a graph of the electrical signal at node 5 during operation of the circuit of FIG. 2.

When the engine initially starts, flywheel 30 rotates and produces power pulses in windings T1 and T2. The initial few rotations are insufficient to create the steady voltage signal shown in FIG. 8, therefore ECU 58 is not initially operative. During those first rotations of crankshaft 24, the voltage signal at node 4 actuates fuel injector 44. The strength and duration of that signal creates a highly fuel rich combustion mixture within cylinder 22. Subsequently, ECU 58 becomes operative and initiates a pulse width modulated signal through resistor R2 to node 5 at the base of transistor Q1. FIG. 5 shows the signal apparent at node 5, which periodically energizes transistor Q1 and thereby interrupts the current at node 9, in effect limiting the duration of the actuation of fuel injector 44.

The above described sequence of operation requires that the coils be at a specific rotational position which varies with the physical dimensions of the engine and the electronic components of the ignition and injection systems. One possible arrangement uses a single winding to actuate both the spark plug and the fuel injector, utilizing a cam activated switch to alternately connect the spark plug and fuel injector at the appropriate points in the four stroke cycle. Other possible arrangements include separate windings mounted on different poles of the laminations. One of ordinary skill appreciates that several alternative arrangements may provide the direct actuation of the fuel injector by the crankshaft.

ECU 58 determines the actuation of fuel injector 44 by monitoring load and speed conditions of the engine. ECU 58 is connected to MAP sensor 60 through feedback line 62, receiving a signal indicative of the current load of the engine. ECU 58 is also connected to node 10 through feedback line 64 which includes current limiting resistor R3 and FET Q3. The signal apparent at node 10 is inverse to the signal depicted in FIG. 3. ECU 58 receives a voltage signal indicative of the actuation of fuel injector 44, and has an internal timer to thereby determine the speed of the engine. The resistor R4 limits the amount of power diverted through feedback line 64. The gate of FET Q3 provides a voltage threshold trigger which node 10 must exceed before triggering is perceptible by ECU 58. ECU 58 includes a look up table for various combinations of observed load/speed conditions to determine the duration of the pulse width modulated signal provided at node 5.

The present invention may be practiced by using the following values for the circuit elements described above:

| Label | Value |
|---|---|
| R1 | 100 KΩ |
| R2 | 33 KΩ |
| R3 | 100 KΩ |
| R4 | 33 KΩ |
| C1 | 100 μf, 25 VDC |
| C2 | 2200 μf, 16 VDC |
| C3 | 100 μf, 25 VDC |
| D1–D4 | WL005F |
| D5–D8 | WL005F |
| Q1 | 2N2222A |
| Q2 | MTP75N05HD |
| Q3 | IRFD123R |

In the preferred embodiment, voltage regulator 56 comprises a Motorola component identified as LM2931AD-5.0, ECU 58 comprises a Motorola component identified as XC68HC05P9, and MAP sensor 60 comprises a Motorola component identified as MPX4100AP.

It should be understood that the signals generated by the circuitry of the present invention may take many forms, such as voltage levels as disclosed, logic levels, polarity, current levels, etc. Also, the deenergization of the fuel injector may be accomplished by interrupting the current flow (as disclosed) or by diverting the current flow to ground.

While this invention has been described as having a preferred design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A batteryless internal combustion engine comprising:

a crankcase having a cylinder bore;

a crankshaft rotatably disposed in said crankcase, said crankshaft including a flywheel and a magnet disposed on said flywheel, said crankshaft being operably connected to a piston disposed in said cylinder bore;

a fuel injector in communication with a fuel supply to inject quantities of fuel into said cylinder bore at an injection location; and an induction coil disposed adjacent to said flywheel and to said magnet during the rotation of said flywheel, said induction coil coupled to said fuel injector whereby rotation of said flywheel generates a pulse in said induction coil and directly actuates said fuel injector.

2. The internal combustion engine of claim 1 further comprising a fuel pump driven by said crankshaft.

3. The internal combustion engine of claim 1 further comprising a spark plug disposed in said cylinder and an ignition coil disposed adjacent to said flywheel, said ignition coil coupled to said spark plug whereby rotation of said flywheel generates a spark in said spark plug.

4. The internal combustion engine of claim 1 further comprising a timing control circuit operably connected to said fuel injector, said timing control circuit adapted to regulate the operation of said fuel injector.

5. The internal combustion engine of claim 4 wherein said timing control circuit is connected to said induction coil, said timing control circuit interrupting said induction coil when the duration of the pulse from said induction coil exceeds a calculated duration to close said fuel injector.

6. The internal combustion engine of claim 4 further comprising a voltage regulator providing power to said timing control circuit, said voltage regulator coupled to said induction coil.

7. The internal combustion engine of claim 4 further comprising a pressure sensor disposed at said injection location, said timing control circuit being connected to said pressure sensor.

8. The internal combustion engine of claim 4 wherein said timing control circuit regulates the operation of said fuel injector based on an observed frequency of pulses from said induction coil.

9. The internal combustion engine of claim 4 further comprising a switch between said fuel injector and ground, said timing control circuit being operatively associated with said switch and being capable of interrupting said switch whereby said fuel injector is deenergized.

10. The internal combustion engine of claim 9 wherein said timing control circuit provides a modulated pulse width signal to said switch to regulate the operation of said switch and thereby regulate the actuation of said fuel injector.

11. A method of operating a batteryless internal combustion engine, the engine including a crankshaft having a flywheel with a magnet, the engine also including a fuel injection system with a fuel injector, said method comprising the steps of:

rotating the flywheel so that the magnet passes in close proximity to an induction coil thereby generating a pulse therein; and transmitting the pulse to the fuel injector to directly actuate the fuel injector by the pulse from the induction coil.

12. The method of claim 11 further comprising the step of driving a fuel pump by the crankshaft to provide pressurized fuel to the fuel injector.

13. The method of claim 11 wherein the engine includes a spark plug connected to an ignition coil disposed adjacent to the flywheel, said method further comprising the step of generating a pulse in the ignition coil by means of the rotating magnet and thereby creating a spark in the spark plug.

14. The method of claim 11 further comprising the step of operating a timing control circuit after the step of transmitting the pulse to the fuel injector, and the step of regulating the operation of the fuel injector with the timing control circuit.

15. The method of claim 14 wherein the regulating step includes interrupting the induction coil when the duration of the pulse from the induction coil exceeds a calculated duration to close the fuel injector.

16. The method of claim 14 wherein the step of operating the timing control circuit includes providing power to the timing control circuit by a voltage regulator powered by the induction coil.

17. The method of claim 14 wherein the regulating step includes monitoring a pressure sensor to determine how to regulate the fuel injector.

18. The method of claim 14 wherein the timing control circuit regulates the fuel injector based on an observed frequency of pulses from the induction coil.

19. The method of claim 14 wherein the regulating step includes interrupting a switch between the fuel injector and ground whereby the fuel injector is deenergized.

20. The method of claim 19 wherein the regulating step includes providing a modulated pulse width signal to the switch.

* * * * *